US008215210B2

(12) United States Patent
Gourraud et al.

(10) Patent No.: US 8,215,210 B2
(45) Date of Patent: Jul. 10, 2012

(54) METHOD OF MACHINING A FACE OF AN OPHTHALMIC LENS THAT IS PRISM-BALLASTED AT THE CENTRE

(75) Inventors: Alexandre Gourraud, Charenton le Pont (FR); Loic Quere, Charenton le Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 1109 days.

(21) Appl. No.: 11/886,471

(22) PCT Filed: Mar. 10, 2006

(86) PCT No.: PCT/FR2006/000533

§ 371 (c)(1), (2), (4) Date: Sep. 17, 2007

(87) PCT Pub. No.: WO2006/097606

PCT Pub. Date: Sep. 21, 2006

(65) Prior Publication Data

US 2008/0190254 A1 Aug. 14, 2008

(30) Foreign Application Priority Data

Mar. 17, 2005 (FR) ..... 05 02651

(51) Int. Cl.
*B24B 13/00* (2006.01)
*B23B 5/40* (2006.01)

(52) U.S. Cl. ..... 82/1.11; 82/118

(58) Field of Classification Search ..... 82/1.11, 82/17–19, 120, 121, 117, 118
See application file for complete search history.

(56) References Cited

U.S. PATENT DOCUMENTS

| | | | | | |
|---|---|---|---|---|---|
| 1,871,123 | A * | 8/1932 | Laabs | 451/42 |
| 3,662,040 | A * | 5/1972 | Urbach et al. | 264/1.8 |
| 4,592,684 | A * | 6/1986 | Baker | 409/132 |
| 4,852,436 | A * | 8/1989 | Benjamin | 82/19 |
| 5,148,632 | A * | 9/1992 | Adler et al. | 451/232 |
| 5,195,407 | A * | 3/1993 | Takeno et al. | 82/1.11 |
| 5,440,798 | A * | 8/1995 | Weymouth, Jr. | 29/527.6 |
| 5,562,527 | A * | 10/1996 | Nauche | 451/9 |
| 7,160,174 | B2 * | 1/2007 | Kiontke et al. | 451/8 |
| 7,207,863 | B2 * | 4/2007 | Miyazawa | 451/5 |
| 2006/0003674 | A1 * | 1/2006 | Miyazawa | 451/5 |
| 2006/0276107 | A1 * | 12/2006 | Kiontke et al. | 451/8 |

FOREIGN PATENT DOCUMENTS

| | | | |
|---|---|---|---|
| EP | 0 758 571 | | 2/1997 |
| EP | 1 449 616 | | 8/2004 |
| JP | 2006326833 | A * | 12/2006 |
| JP | 2008023687 | A * | 2/2008 |
| RU | 2004996 | C1 * | 12/1993 |
| SU | 1759563 | A1 * | 9/1992 |

* cited by examiner

*Primary Examiner* — Boyer D Ashley
*Assistant Examiner* — Sara Addisu
(74) *Attorney, Agent, or Firm* — Young & Thompson

(57) ABSTRACT

The invention relates to a method of machining a face (3) of an ophthalmic lens (1) with a main machining step in which the position of a machining tool (8) is synchronised with the angular position of the ophthalmic lens (1) which is rotated around an axis of rotation (4) that is transverse to the face (3), in order to provide the face with a machined surface that is asymmetrical in relation to the axis of rotation (4) of the ophthalmic lens (1); and a complementary machining step in which a recess (22) is machined around the axis of rotation (4) of the lens (1).

14 Claims, 13 Drawing Sheets

Fig. 1
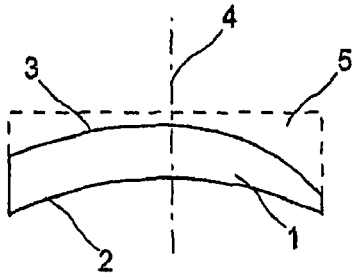
Fig. 2
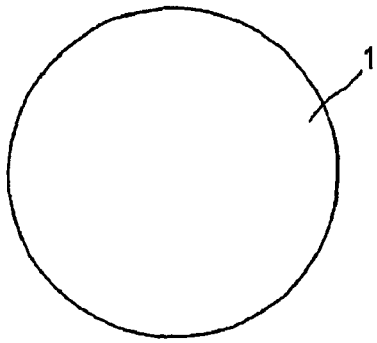
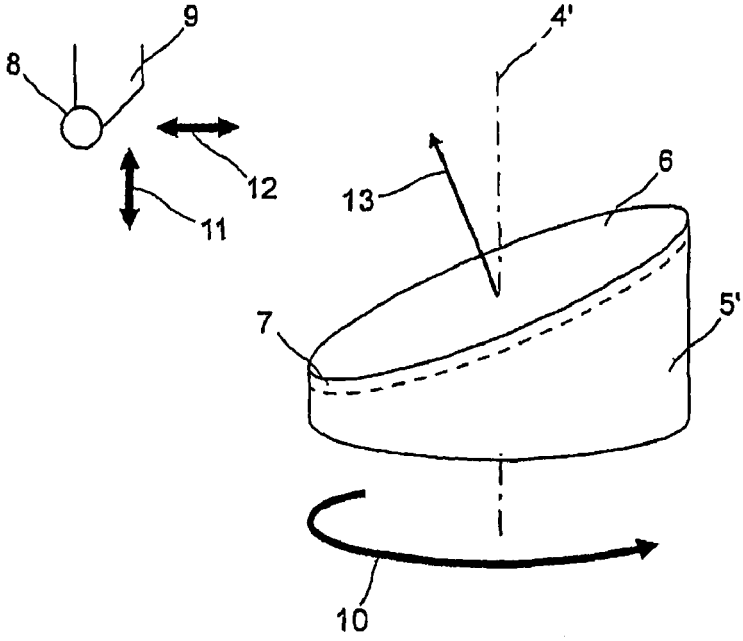
Fig. 3

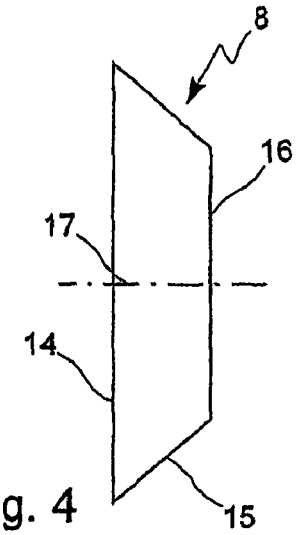
Fig. 4
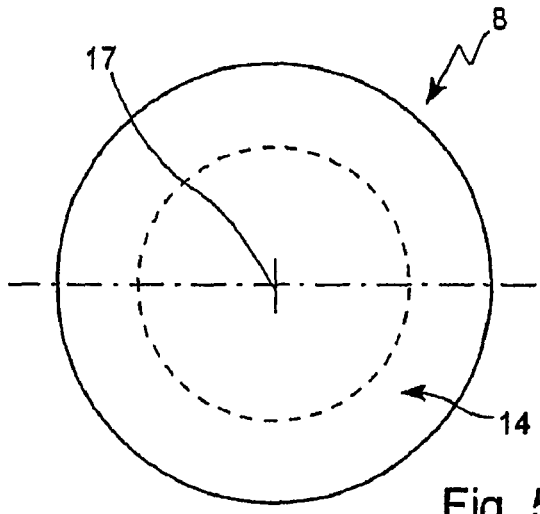
Fig. 5
Fig. 6
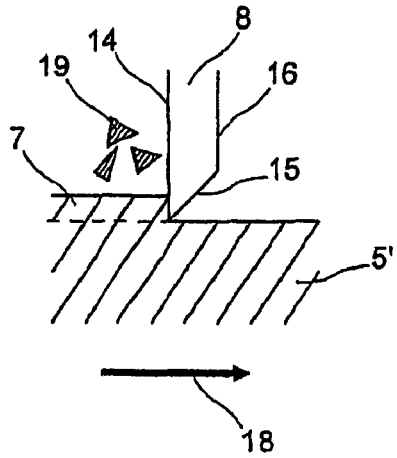
Fig. 7
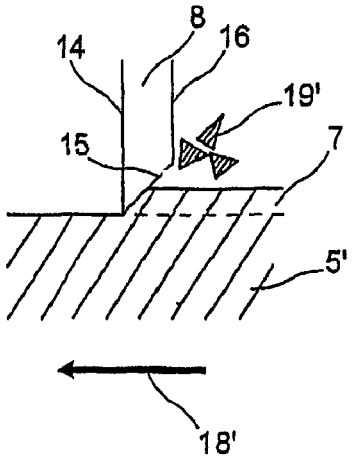

METHOD OF MACHINING A FACE OF AN OPHTHALMIC LENS THAT IS PRISM-BALLASTED AT THE CENTRE

The invention concerns the field of the fabrication of ophthalmic lenses intended to be inserted in an eyeglass frame and adapted to correct the sight of a wearer.

It concerns more particularly a method of machining a face of such an ophthalmic lens.

The fabrication of an ophthalmic lens generally includes a first phase during which a blank is produced by molding and/or machining having an edge delimited by a front face and a rear face, and a second phase during which the blank is trimmed, i.e. its edge is machined to change it to a shape adapted for insertion in a given eyeglass frame.

During the first phase, correction properties corresponding to the prescription of the future wearer are conferred on the ophthalmic lens by the shape and the relative dispositions of the front and rear faces (the rear face being that which is turned towards the eye of the wearer of the correcting eyeglasses).

Certain ophthalmic lenses, in particular so-called "progressive" lenses for correcting presbyopia, have a front face or a rear face that is asymmetrical with respect to the longitudinal axis of the cylinder formed by the edge of the untrimmed lens.

If a face of the lens is symmetrical with respect to that longitudinal axis, that face can be machined on the blank by making use of a standard turning process, the blank being driven in rotation about said axis while a machining tool comes into contact with the lens to machine that symmetrical face.

On the other hand, if an asymmetrical face must be produced, the standard turning processes can no longer be employed in that they enable the machining only of shapes that are symmetrical with respect to the rotation axis of the part.

One solution for machining asymmetrical surfaces consists in making use of a milling process during which a rotating milling tool, mobile relative to the blank, machines the asymmetrical face. These milling processes applied to the field of ophthalmic lenses generally procure a finish quality inferior to that procured by a turning process.

Another solution enables a turning process to be made use of for machining an asymmetrical face on the blank. This is a process during which the ophthalmic lens is driven in rotation about the longitudinal axis passing through the faces of the lens while a machining tool is synchronized with the angular position of the ophthalmic lens in such a manner as to follow the asymmetrical shape that it has to machine on the lens.

The documents EP 1 449 616 and GB 2 058 619 describe such a method for machining an asymmetrical face on a lens driven in rotation by a turning device.

The object of the invention is to improve that type of method.

To this end, the invention is directed to a method of machining a face of an ophthalmic lens including a main machining step during which the position of a machining tool is synchronized with the angular position of the ophthalmic lens driven in rotation about a rotation axis transverse to said face to machine on said face a surface that is asymmetrical with respect to the rotation axis of the ophthalmic lens, this method being characterized in that it includes a complementary step of machining a recess around the rotation axis of the ophthalmic lens.

Such a machining process can produce a prism-ballasted surface at the center on a lens driven in rotation and minimize, or even eliminate, the residual volume of material responsible for a phenomenon known as inverse machining.

In fact, during an operation of machining a face prism-ballasted at the center in which the position of a machining tool is synchronized with the angular position of the ophthalmic lens driven in rotation, the surface to be machined is asymmetrical in the vicinity of the rotation axis of the lens, i.e. the normal to the surface at the point of intersection with the rotation axis of the lens is at an angle to said rotation axis. As the machining tool approaches the rotation axis of the part while it is working, a portion of the material to be removed necessitates that a portion of the tool continue its forward movement beyond the rotation axis of the part.

This residual volume, which is called a "nipple", is consequently removed by forcing intermittent inverse operation of the tool, i.e. with a direction of relative displacement between the lens and the tool that is the opposite of the working direction for which the tool was designed.

In that the method of the invention minimizes, or even eliminates, the nipple referred to, the tool is constantly or virtually constantly in nominal use. This use is referred to as "nominal" in that it is that intended by the manufacturer of the tool. Using the tool in the direction specified therefore eliminates premature wear of the tool or localized damage.

According to one preferred feature, said recess defines a portion of said asymmetrical surface.

Said complementary machining step can further be affected using the machining tool or a tool other than the machining tool.

According to another preferred feature, said complementary machining step is performed without synchronizing the position of a tool for machining the recess with the angular position of the ophthalmic lens driven in rotation.

In this case, the tool intended to machine the recess is in contact with the ophthalmic lens over only an angular portion of the rotation of the ophthalmic lens.

Moreover, the machining of the recess can be affected by moving a tool in the direction of the rotation axis of the ophthalmic lens. The forward movement of said tool can be stopped when the center of the tool is positioned on the rotation axis of the ophthalmic lens.

The recess can have an edge passing through the rotation axis of the ophthalmic lens.

According to one preferred feature, a residual volume of material is adapted to be machined in the universe mode by the machining tool during the main machining step, this residual volume being substantially centered relative to the rotation axis of the ophthalmic lens. This residual volume can be machined during the main machining step or, to the contrary, the main machining step can be stopped before machining said residual volume.

Other features and advantages of the invention will become apparent in the light of the following description of one preferred embodiment given by way of nonlimiting example and with reference to the appended drawings, in which:

FIGS. 1 and 2 represent a progressive ophthalmic lens, seen respectively in profile and from above, which can be obtained by a method according to the invention;

FIG. 3 is a diagrammatic perspective view showing a machining tool adapted to cooperate in a turning operation with a prism-ballasted cylindrical part driven in rotation;

FIGS. 4 and 5 represent the machining tool from FIG. 3 seen respectively in profile and face-on;

FIGS. 6 and 7 represent diagrammatically two working modes of the tool from FIGS. 4 and 5, respectively a nominal mode and an inverse mode;

Figure 8:
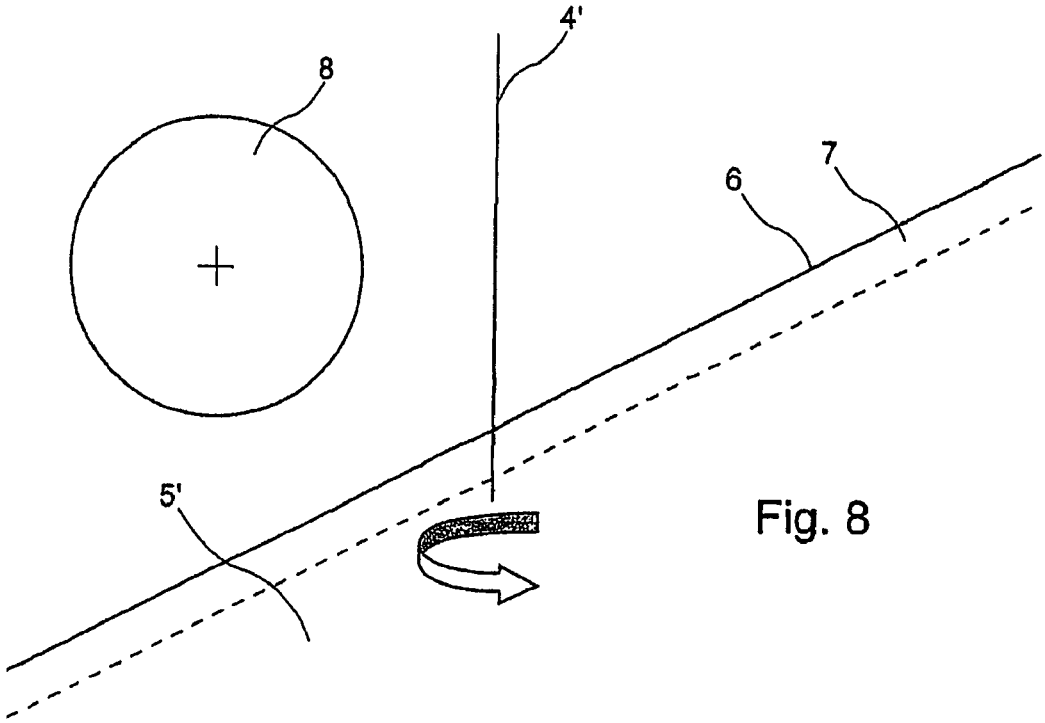
FIG. 8 represents diagrammatically the machining tool and the prism-ballasted surface from FIG. 3.

FIGS. 1 and 2 show the shape of a progressive ophthalmic lens 1. The view from above in FIG. 2 shows that this lens 1 has a circular contour. That circular contour will be machined afterwards to correspond to the contour of the eyeglass frame chosen.

FIG. 1 shows the typical profile of such a progressive lens 1. This lens 1 has a rear face 2 the curvature whereof is regular and a front face 3 the curvature whereof is greatly accentuated in a particular area of the lens 1.

The lens 1 therefore does not exhibit rotational symmetry with respect to a longitudinal axis 4 passing through the center of the circular contour of the lens 1.

To obtain such a lens 1, it is routine to start from a cylinder of raw material, the rear face 2 possibly having been premolded, and to proceed to machining the front face 3 from the raw part 5 shown diagrammatically in dashed outline in FIG. 1.

Because of the asymmetry of the front face 3 of the lens 1 with respect to the axis 4, this face 3 can be obtained by turning only by synchronizing the position of a machining tool with the angular position of the ophthalmic lens driven in rotation about the axis 4.

To simplify the explanation of the method of the invention, turning operations will be described with reference to the example shown diagrammatically in FIG. 3 and consisting in machining a raw part 5' (hereinafter called the work 5') having a prism-ballasted surface 6.

More precisely, the operations that will be described hereinafter by way of example aim to remove by machining a layer of material 7 of constant thickness from the prism-ballasted surface 6 of the work 5' during turning operations making use of a tool 8 associated with a tool-carrier 9.

The work 5' is driven in rotation in the direction 10 about an axis 4' while the tool 8 is mobile in the direction 11 parallel to the axis 4' and in the direction 12 transverse to the axis 4'.

A turning device, not shown, is adapted to drive the work 51 in rotation in the direction 10 and to synchronize the position of the tool 8 in the direction 11 with that rotation, as explained hereinafter.

The normal 13 to the prism-ballasted surface 6 does not extend along the axis 4', which is a consequence of the asymmetry of that surface 6 with respect to the axis 4'.

Although, for reasons of clear explanation, the operations that will be described hereinafter aim to remove a layer 7 of constant thickness from the work 5' in the FIG. 3 configuration, these operations can be applied to any surface where the normal at the center is different from the longitudinal axis of the part, and in particular to the progressive ophthalmic lens from FIGS. 1 and 2.

The machining tool 8 shown in FIG. 3 is represented in detail in FIGS. 4 and 5, respectively in profile and face-on.

This tool 8 has a generally circular shape and features a working face 14 forming a cutting edge with a lateral bevel 15 linking the working face 14 to a rear face 16 having a smaller diameter than the working face 14.

This tool 8 is held in a tool-carrier 9, conforming to FIG. 3, by a screw (not shown) fixing the center 17 of the tool 8 to the tool-carrier 9, or by any means enabling rigid connection of the tool 8 to the tool-carrier 9 so that the cutting edge is accessible over at least a portion of the circumference of the tool 8 for machining the work 5'.

The tool 8 can be made of polycrystalline diamond, monocrystalline diamond, or any other material suitable for the production of a turning tool.

FIGS. 6 and 7 show the turning tool 8 respectively in a so-called "nominal" cutting configuration and in a so-called "inverse" cutting configuration.

FIG. 6 shows that, in the nominal cutting configuration, the work 5' to be machined is driven in rotation in the direction 18 and the tool 8 is positioned so that its cutting edge attacks the layer 7 to be removed at its working face 14 producing chips 19. This configuration is that for which this kind of tool 8 is designed.

FIG. 7, on the other hand, shows the tool 8 in the same position as that of FIG. 6, whereas the work 5' is driven in rotation in the direction 18' that is the opposite of the direction 18 in FIG. 6. Here the tool 8 is operating in an inverse mode, i.e. the layer 7 of material to be removed is attacked by the bevel 15 and not by the working face 14. In this configuration, the chips 19' are produced anyway and the layer 7 of material is removed, but this is an improper use of the tool 8 that can lead to premature wear or even immediate damage to the cutting edge of the tool 8.

During machining, the tool 8 must therefore be used as much as possible in its nominal configuration rather than in its inverse configuration.

FIG. 8 is a diagram showing the elements from FIG. 3, namely the tool 8 (here minus its tool-carrier 9 to simplify the drawing), the surface 6 of the work 5' and the layer 7 of material to be machined represented diagrammatically between the solid line and the dashed line.

The prism-ballasted surface 6 is driven in rotation about the axis 4'.

Figure 9:
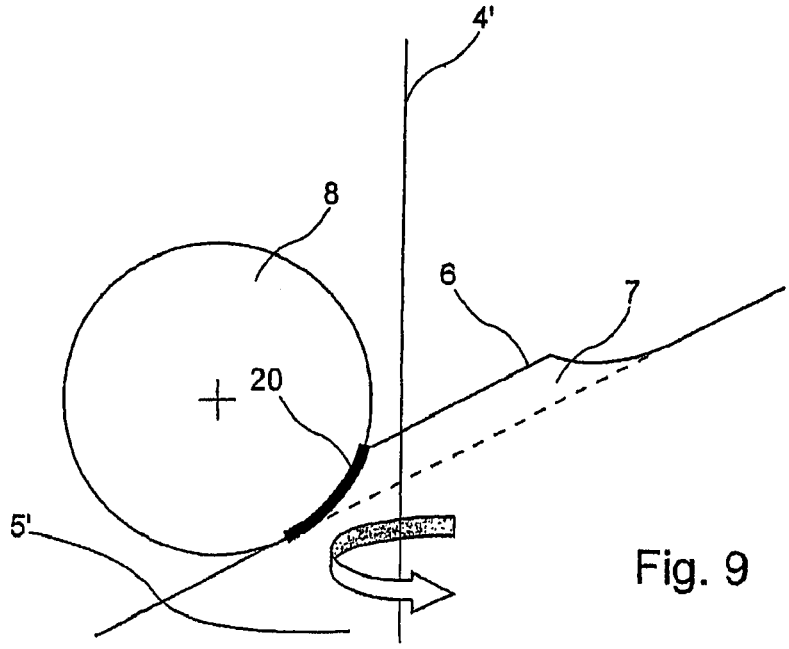
FIG. 9 shows a phase of machining of the prism-ballasted surface by the tool.

As shown in FIG. 9, the turning technique employed here for machining the layer 7 of the work 5' by means of the tool 8 enables the tool 8 to approach the work 5', which is driven in rotation, to proceed with the machining of the layer 7 in the region of a machining line 20 from which the chips are formed.

Figure 10:
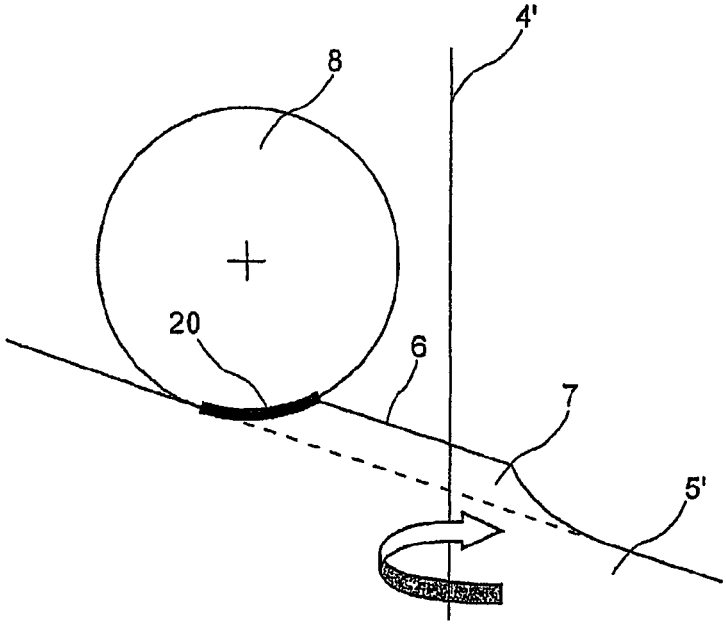
FIG. 10 shows the same machining phase as FIG. 9, after the prism-ballasted part has undergone a rotation of 180°.

FIG. 10 also shows the machining of the layer 7 by the tool 8 when the work 5' has effected a rotation of 180° relative to its FIG. 9 position, during its continuous driving in rotation. This FIG. 10 shows that, to continue to machine the layer 7 in the region of the machining line 20, the tool 8 has been moved parallel to the rotation axis 4' by a distance that depends on the asymmetry of the surface 6.

This machining technique enables the tool 8 to be permanently in contact with the layer 7 of material to be machined (even though it is asymmetrical), which is driven in rotation, thanks to the synchronization of the position of the tool 8 with the angular position of the work 5'.

The operations effected using this machining technique are described hereinafter with reference to a representation conforming to FIG. 11 in which the observer is placed in the frame of reference of the work 5', which is therefore considered stationary, while it is the tool 8 that is considered to be mobile in rotation about the axis 4' in the direction 21. Although equivalent to that of FIGS. 9 and 10 in terms of relative movement of the tool 8 with respect to the work 5', this representation allows the use of drawings like that of FIG. 11 in which two tools each corresponding to one position of the tool for each half-turn of the work 5' are conventionally represented. In the figures, elements seen in each of these positions of the tool 8 are indicated by a suffix A in the position to the left of the axis 4' and by a suffix B in the position to the right of the axis 4'.

Figure 11:
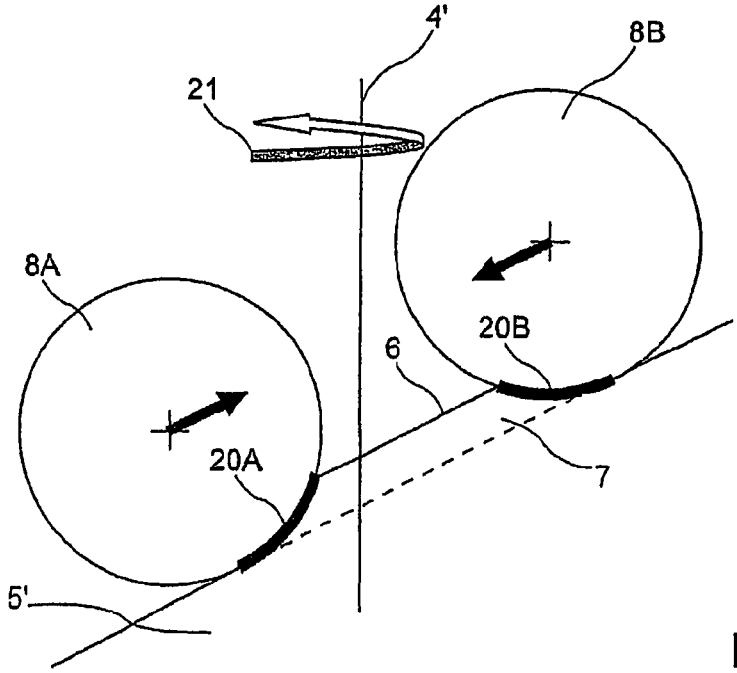
FIG. 11 represents diagrammatically and simultaneously the views of FIGS. 9 and 10.

Thus the FIG. 11 representation combines FIGS. 9 and 10.

Figure 21:
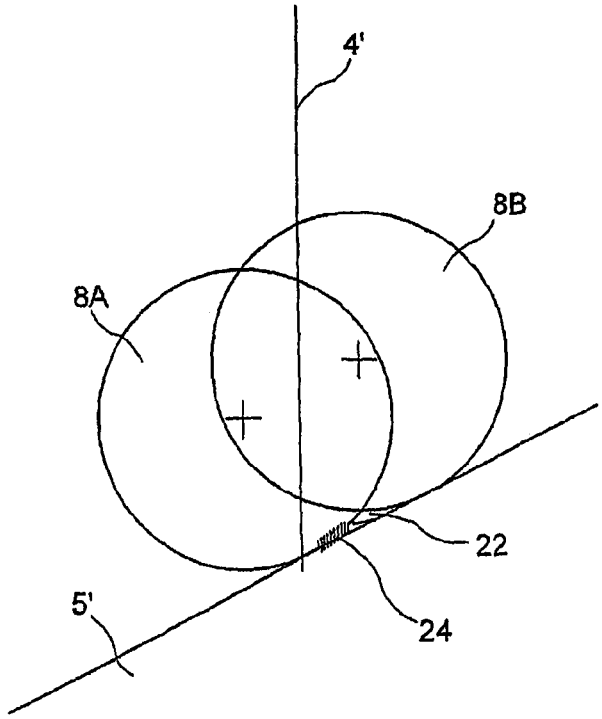

In all the figures, the machining line is represented in bold line when the tool 8 is working in the nominal mode (for example in FIG. 11) and is represented by cross-hatching when the tool 8 is operating in the inverse mode (for example in FIG. 21).

The method of the invention will now be described with reference to FIGS. 12 to 23 using the FIG. 11 representation.

Figure 12:
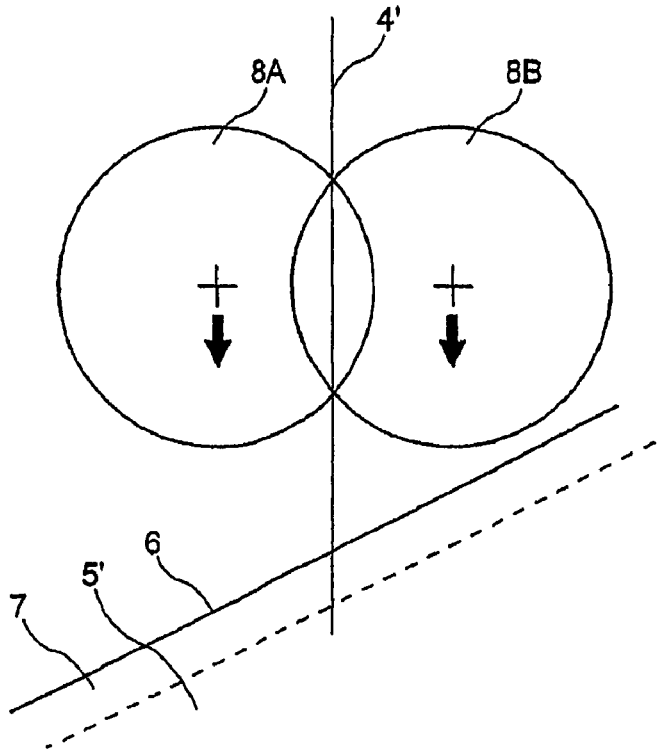
FIGS. 12 to 17 show chronologically the complementary step of the machining method of the invention of machining a recess.

Referring to FIG. 12, a first step consists in machining a recess around the rotation axis 4' of the work 5'. To this end the tool 8 is first used in conventional turning, i.e. without synchronizing the position of the tool 8 with the angular position of the work 5'.

Thus the tool 8 approaches the surface 6 along the axis 4'.

Figure 13:
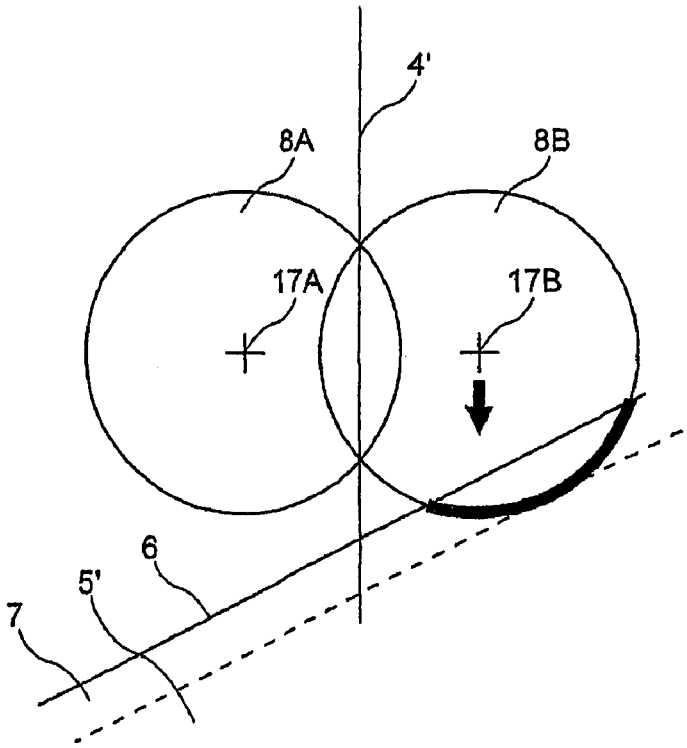

Referring to FIG. 13, the tool 8 enters into the material of the work 5' when the center 17 of the tool 8 is at a distance from the axis 4' substantially equal to the radius of the tool 8. The tool 8 penetrates into the material of the work 5' to a height adapted to the thickness of the layer 7 of material to be removed (see the position 8B of the tool 8), i.e. the required depth of pass.

This penetration of the tool 8 into the material being effected in accordance with a conventional turning operation applied to a prism-ballasted surface 6, the tool 8 at times performs the machining operation (position 8B) and at times is positioned away from the surface 6 (position 8A).

Figure 14:
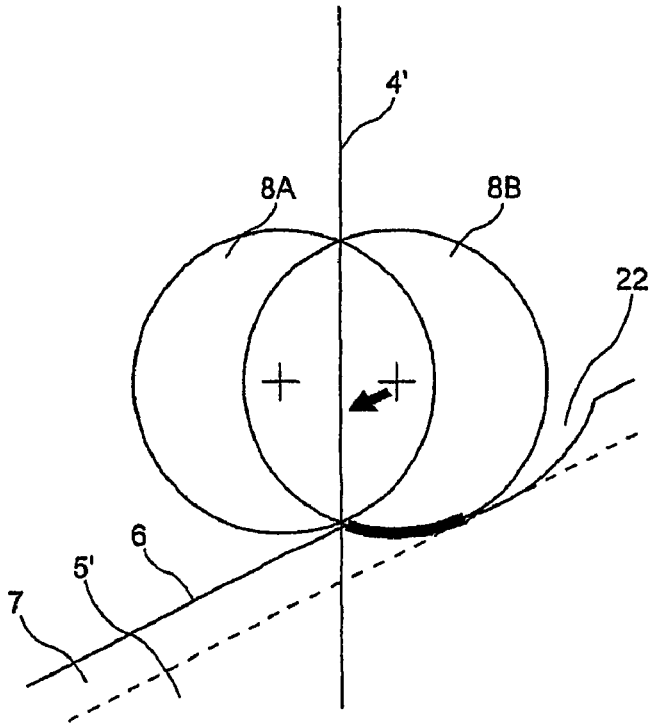

Referring to FIG. 14, the tool 8 is then moved in the direction of the rotation axis 4' at a machining depth adapted to the thickness of the layer 7 to form the recess 22 as it moves.

Figure 15:
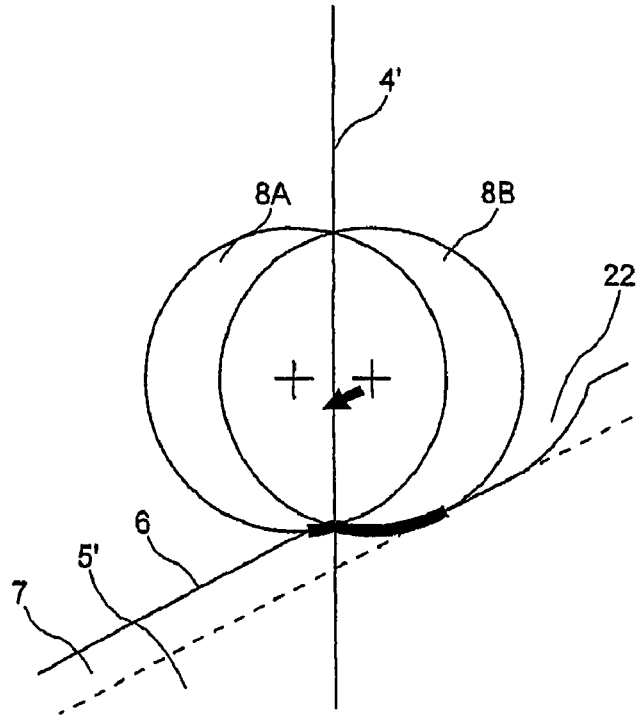
Figure 16:
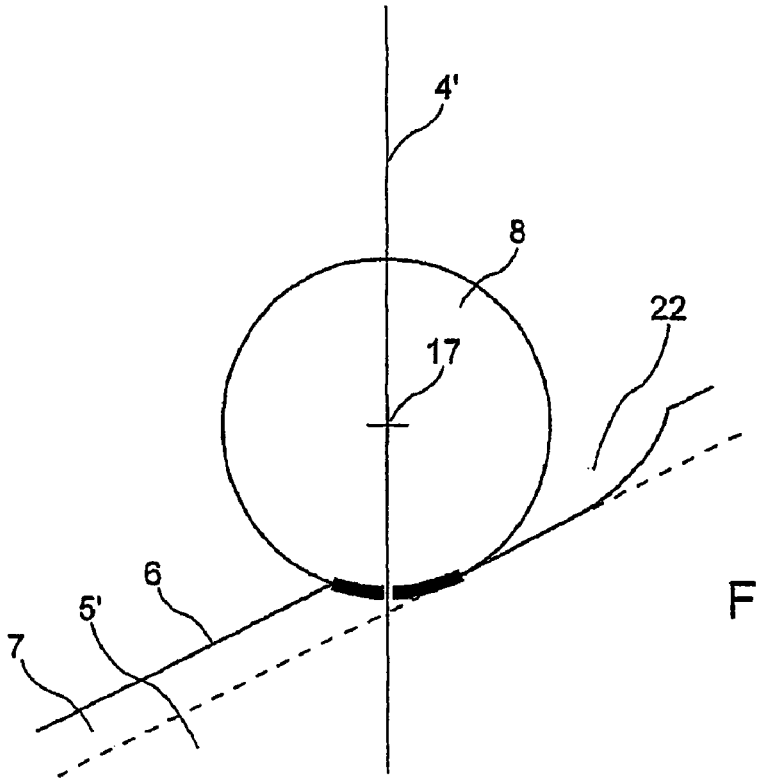

The recess 22 is then continued until the tool 8 arrives at a central position, i.e. until its center 17 is positioned on the axis 4' (see FIGS. 15 and 16).

Figure 17:
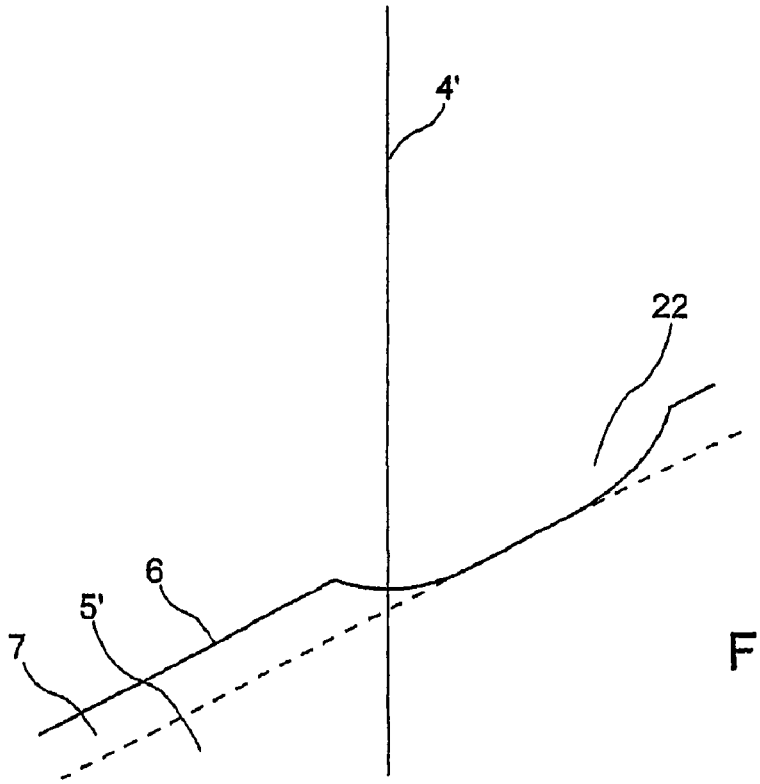

FIG. 17 shows the recess 22 produced by the operation of FIGS. 12 to 16.

Once the recess 22 has been produced, machining operations proper are carried out, as shown in FIGS. 18 to 22. Those machining operations are now carried out using the turning technique, described hereinabove, during which the position of the tool 8 is synchronized with the angular position of the work 5'.

Figure 18:
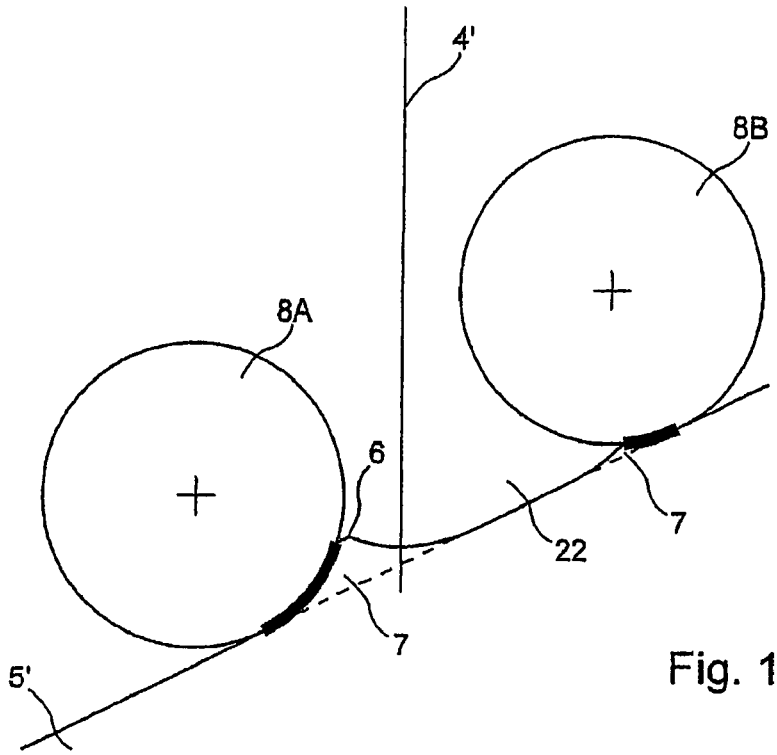
FIGS. 18 to 22 show chronologically the step of the machining method of the invention that follows said complementary step of FIGS. 12 to 17.

FIG. 18 shows the penetration of the tool 8 into the material of the work 5' in the layer 7 of material to be machined.

Figure 19:
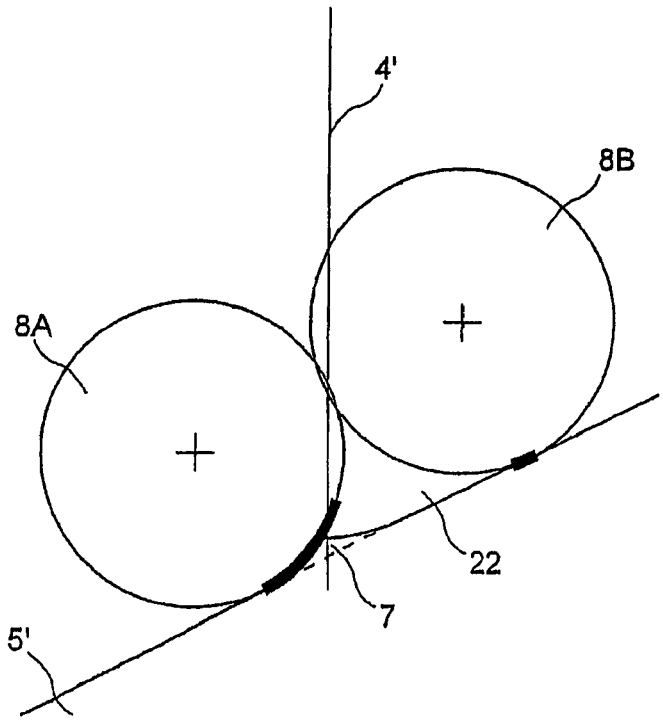

FIG. 19 shows the forward movement of the tool 8 in the direction of the axis 4'.

Figure 20:
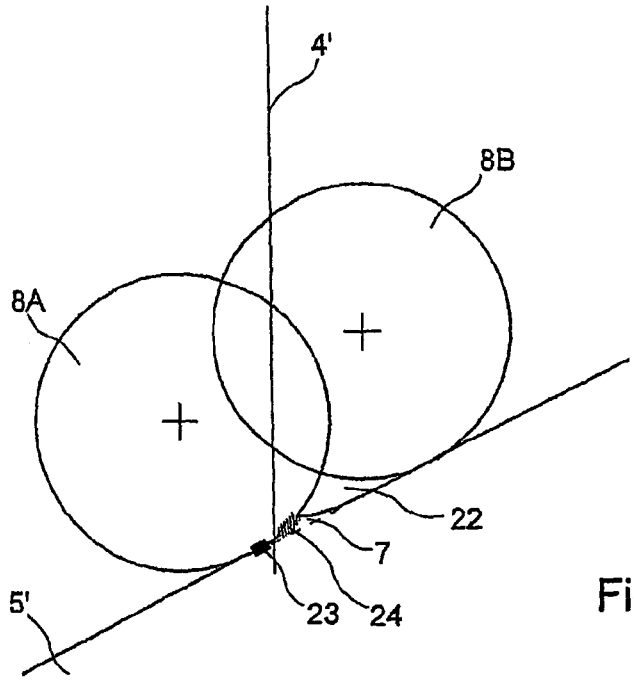

Starting from FIG. 20, the tool 8, in its position 8A, enters an inverse machining area. In fact, in its position 8A the tool machines the layer 7 in the nominal mode along a machining line 23 and also machines the layer 7 in the inverse mode along a machining line 24 situated on the other side of the axis 4'.

Figure 22:
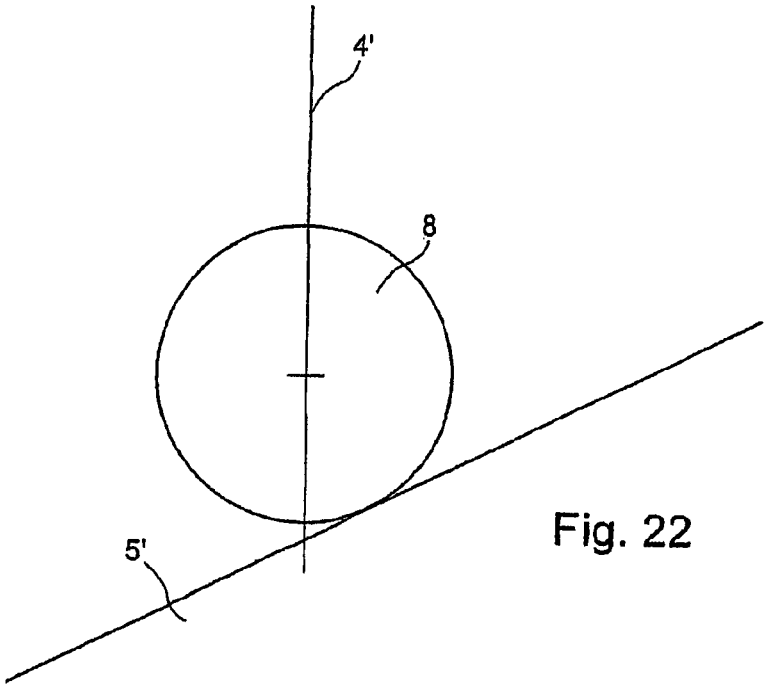

FIG. 21 shows the continuation of the forward movement of the tool 8 which finally machines the layer 7 only in the inverse mode until the tool 8 reaches the FIG. 22 position in which the machining of the layer 7 has finished.

Figure 23:
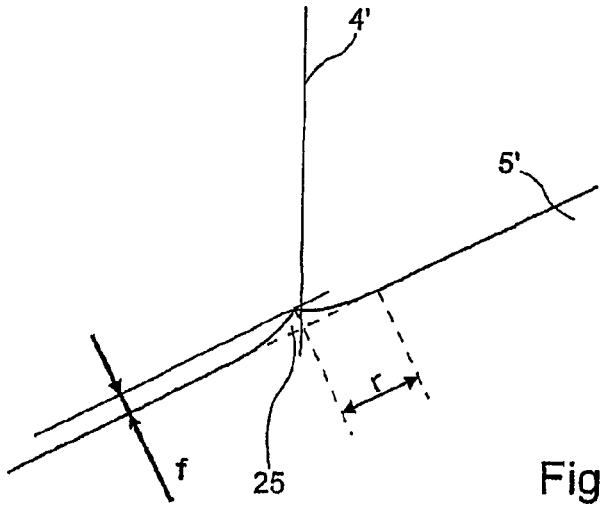
FIG. 23 shows the residual volume of material that is machined with the tool operating in the inverse mode.

FIG. 23 shows the residual volume 25 of material from the layer 7 that remains to be machined before the tool 8 begins to machine in the inverse mode, i.e. just after the FIG. 19 position.

The residual volume 25 represented in FIG. 23 is therefore the volume that will be machined in the inverse mode by the tool 8.

The height f of this residual volume 25 is such that:

$$f=R-\sqrt{R^2-r^2}$$

where R is equal to the radius of the tool 8 and r is equal to the distance between the summit of this residual volume and one of its edges (see FIG. 23).

Alternatively, it is possible to stop machining in the FIG. 19 position and then to eliminate the residual volume 25 by polishing, for example. Thus the tool 8 never operates in the inverse mode.

Note that, even if this variant is not made use of and the residual volume 25 is machined according to FIGS. 20 to 22, the operation of the tool 8 in the inverse mode is limited to this residual volume 25, much less than the total volume of the layer 7 to be machined.

By way of comparison, a machining operation under similar conditions will now be described that does not produce a recess beforehand.

FIGS. 24 to 27 show such an operation.

Figure 24:
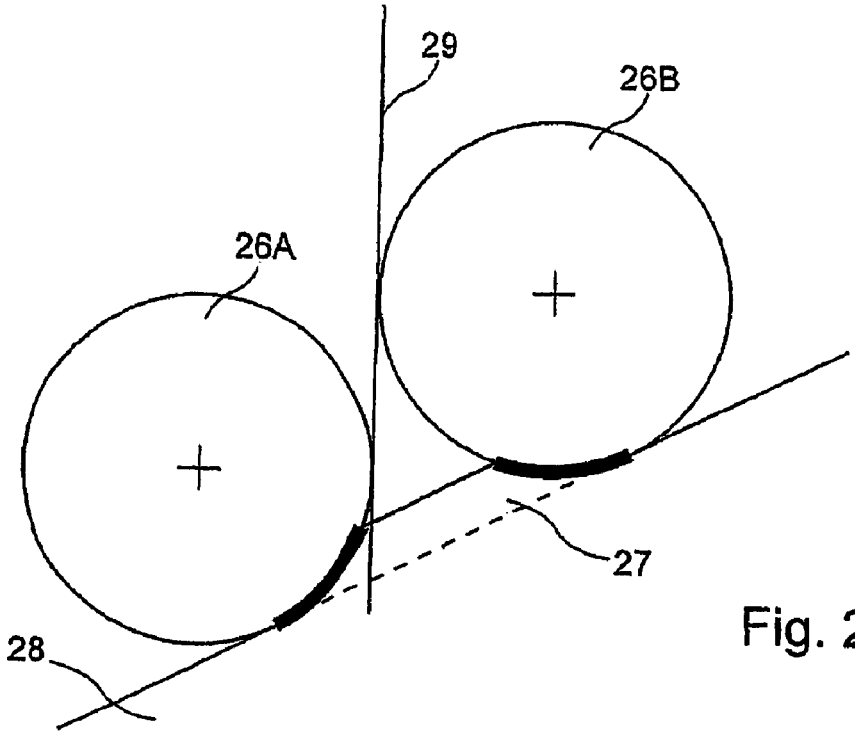
FIGS. 24 to 27 show chronologically an operation of machining the prism-ballasted surface by the tool without machining a recess beforehand.

FIG. 24 shows the machining by a tool 26 of a layer 27 of material to be machined on the work 28. This machining is effected with the position of the tool 26 synchronized with the angular position of the work 28.

This FIG. 24 is the last position of the tool 26 before it begins to operate in the inverse mode since a portion of the machining line 26, in the region of its position 26A, will pass to the other side of the rotation axis 29 of the work 28.

Figure 25:
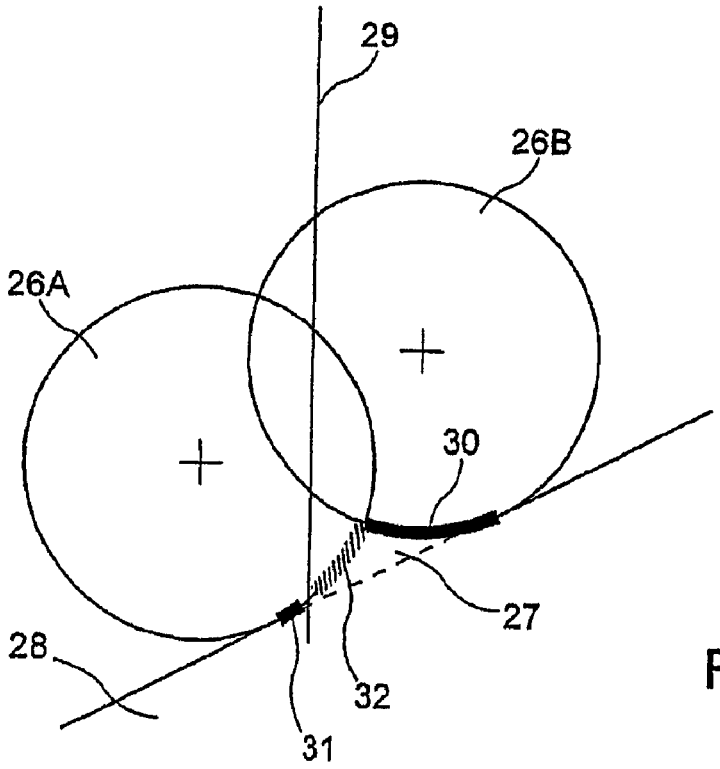

FIG. 25 shows that in fact the tool 26 works in the nominal machining mode in its position 26B along a machining line 30 whereas, in the region of its position 26A, it works on the one hand in the nominal machining mode along a machining line 31 on one side of the axis 29 and on the other hand in the inverse machining mode along a machining line 32 on the other side of the axis 29.

Figure 26:
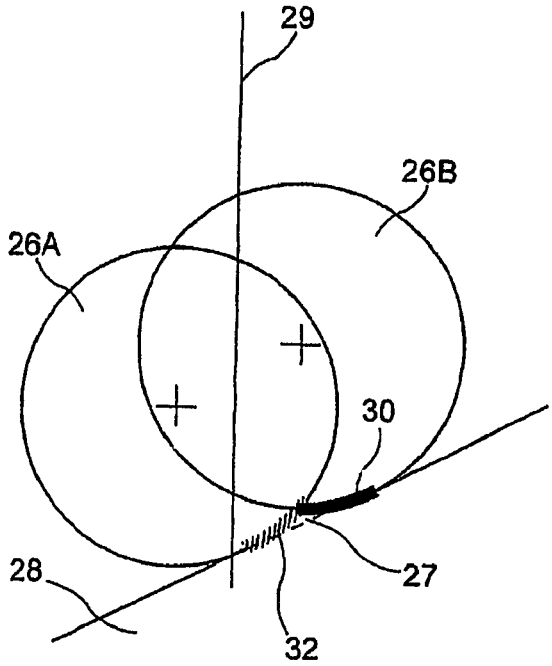
Figure 27:
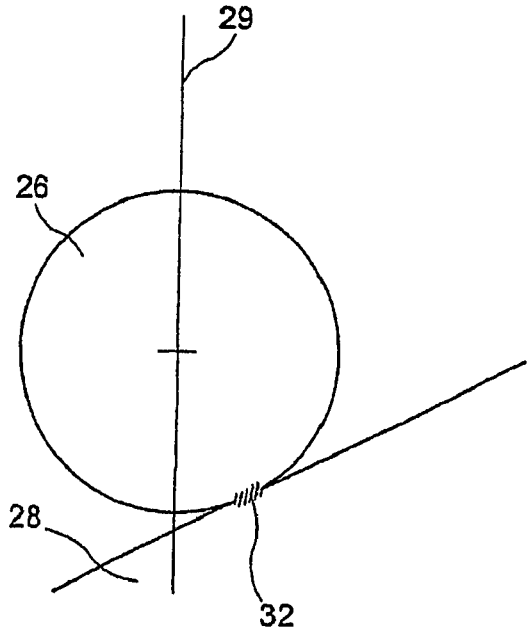

Machining therefore continues in accordance with FIGS. 26 and 27 until the layer 27 is removed completely.

Figure 28:
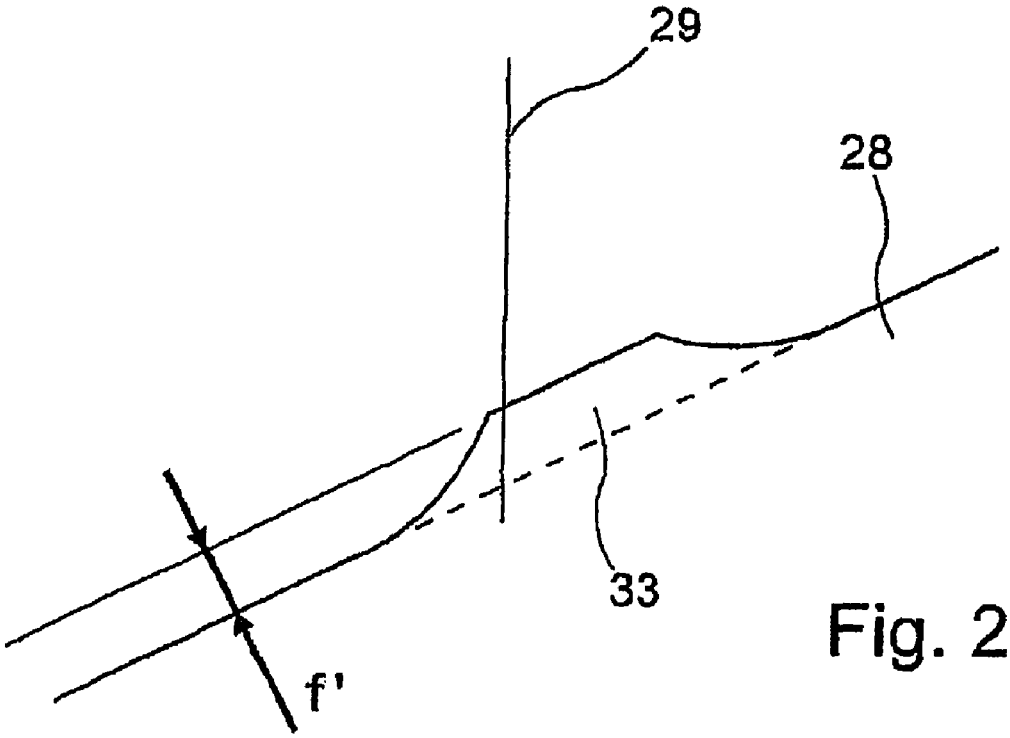
FIG. 28 represents the residual volume of material to be machined by inverse operation of the tool, in the case of the machining operation from FIGS. 24 to 27.

FIG. 28 shows the residual volume 33 of the layer 27 which, starting from the FIG. 24 position, is machined with the tool 26 operating in the inverse mode.

The pass height f' of the residual volume 33 corresponds to the depth of pass defining the layer 7 and is much greater than the height f of the residual volume 25 of the method of the invention (see FIG. 23).

The method of the invention therefore greatly reduces the volume machined in the inverse mode when employing this kind of turning technique in which the position of a tool is synchronized with the angular position of the work to be machined.

The difference between the residual volume 25 of the method of the invention and the residual volume 33 is such that, thanks to the method of the invention, there is very little operation of the machining tool in the inverse mode.

The residual volume 25 being also much less than the residual volume 33, this residual volume 25 can instead be left as it is or polished during a supplementary operation. Thus in this variant the machining tool does not operate in the inverse mode at all.

Variants of the method can be envisaged that do not depart from the scope of the invention. In particular, although the operations of FIGS. 3 to 22 have been described with reference to the machining of a layer 7 of material to be machined of regular thickness over a plane prism-ballasted surface 6, the method of the invention of course applies to the production of an ophthalmic lens according to FIGS. 1 and 2 by removing a layer of material of irregular thickness from the work 5.

The invention claimed is:

1. A method of machining a face (3) of an ophthalmic lens (1) comprising:

a main machining step during which the position of a machining tool (8) is synchronized with the angular position of the ophthalmic lens (1) driven in rotation about a rotation axis (4) transverse to said face (3) to machine on said face a surface that is asymmetrical with respect to the rotation axis (4) of the ophthalmic lens (1); and a complementary step of machining a recess (22) around the rotation axis (4) of the ophthalmic lens (1), said complementary machining step performed before said main machining step, the main machining step performed so that without the complementary machining step, upon the machining tool approaching the rotation axis of the ophthalmic lens, a residual volume of material is removed by forcing an intermittent inverse operation of the machining tool, the complementary machining step performed so that the recess is made at the location of the residual volume, wherein the tool for machining the recess (22) is in contact with the ophthalmic lens (1) during only an angular portion of the rotation of the ophthalmic lens (1).

2. The method according to claim 1, wherein said recess (22) defines a portion of said asymmetrical surface.

3. The method according to claim 2, wherein said complementary machining step is performed using the machining tool (8).

4. The method according to claim 2, wherein said complementary machining step is performed using a tool other than the machining tool (8).

5. The method according to claim 2, wherein the tool for machining the recess (22) is in contact with the ophthalmic lens (1) during only an angular portion of the rotation of the ophthalmic lens (1).

6. The method according to claim 1, wherein said complementary machining step is performed using the machining tool (8).

7. The method according to claim 1, wherein said complementary machining step is performed using a tool other than the machining tool (8).

8. The method according to claim 1, wherein said complementary machining step is performed without synchronizing the position of a tool for machining the recess (22) with the angular position of the ophthalmic lens (1) driven in rotation.

9. The method according to claim 1, wherein the machining of the recess (22) is effected by moving a tool in the direction of the rotation axis of the ophthalmic lens (1).

10. The method according to claim 1, wherein the residual volume of material is adapted to be machined in the inverse mode by the machining tool (8) during the main machining step, this residual volume being substantially centered relative to the rotation axis of the ophthalmic lens (1).

11. The method according to claim 10, wherein said residual volume is machined during the main machining step.

12. The method according to claim 10, wherein the main machining step is stopped before machining said residual volume.

13. A method of machining a face (3) of an ophthalmic lens (1) comprising:

a main machining step during which the position of a machining tool (8) is synchronized with the angular position of the ophthalmic lens (1) driven in rotation about a rotation axis (4) transverse to said face (3) to machine on said face a surface that is asymmetrical with respect to the rotation axis (4) of the ophthalmic lens (1); and a complementary step of machining a recess (22) around the rotation axis (4) of the ophthalmic lens (1), said complementary machining step performed before said main machining step, wherein the tool for machining the recess (22) is in contact with the ophthalmic lens (1) during only an angular portion of the rotation of the ophthalmic lens (1), wherein the forward movement of said tool is stopped upon the center of the tool being positioned on the rotation axis of the ophthalmic lens (1).

14. A method of machining a face (3) of an ophthalmic lens (1) comprising:

a main machining step during which the position of a machining tool (8) is synchronized with the angular position of the ophthalmic lens (1) driven in rotation about a rotation axis (4) transverse to said face (3) to machine on said face a surface that is asymmetrical with respect to the rotation axis (4) of the ophthalmic lens (1); and a complementary step of machining a recess (22) around the rotation axis (4) of the ophthalmic lens (1), said complementary machining step performed before said main machining step, wherein the tool for machining the recess (22) is in contact with the ophthalmic lens (1) during only an angular portion of the rotation of the ophthalmic lens (1), wherein the recess (22) has an edge passing through the rotation axis of the ophthalmic lens (1).

* * * * *